US005906756A

United States Patent [19]

Lee et al.

[11] Patent Number: 5,906,756

[45] Date of Patent: May 25, 1999

[54] METHOD OF MAKING BALANCING DEVICE FOR A DRUM WASHING MACHINE

[75] Inventors: Hyun-Moo Lee; Sam-Yong Jang, both of Suwon, Rep. of Korea

[73] Assignee: Samsung Electronics Co., Ltd., Suwon, Rep. of Korea

[21] Appl. No.: 08/853,453

[22] Filed: May 9, 1997

[30] Foreign Application Priority Data

May 11, 1996 [KR] Rep. of Korea ..... 96-15704
May 23, 1996 [KR] Rep. of Korea ..... 96-17747

[51] Int. Cl.[6] ..... B23K 11/00

[52] U.S. Cl. ..... 219/117.1; 53/83; 68/23.2

[58] Field of Search ..... 219/117.1; 53/83; 68/23.1, 23.2; 74/573 F

[56] References Cited

U.S. PATENT DOCUMENTS

| | | | |
|---|---|---|---|
| 2,141,932 | 12/1938 | Payne | 219/117.1 |
| 2,984,094 | 5/1961 | Belaieff | 68/23.2 |
| 4,314,486 | 2/1982 | Hellwig | 74/573 F |
| 4,674,356 | 6/1987 | Kilgore | 74/573 F |
| 5,374,800 | 12/1994 | Yoneda | 219/117.1 |
| 5,674,417 | 10/1997 | Schaugaard et al. | 53/83 |

*Primary Examiner*—Clifford C. Shaw
*Attorney, Agent, or Firm*—Burns, Doane, Swecker & Mathis, L.L.P.

[57] ABSTRACT

A balancing device for a drum type washing machine is attached to a spin basket of the washing machine. The balancing device includes annular-shaped races that house balls and oil. The balls are seated in each race, and oil is supplied to the inside of each race through a hole formed thereon. Then, the hole is sealed by a welding process.

1 Claim, 9 Drawing Sheets

METHOD OF MAKING BALANCING DEVICE FOR A DRUM WASHING MACHINE

BACKGROUND OF THE INVENTION (1) Field of the Invention

The present invention generally relates to a method of making a balancing device for a drum washing machine. More particularly, it relates to a method of sealing a hole used for supplying oil that is held in a balancing device for a drum washing machine, for the purpose of making movable bodies in the balancing device move smoothly.

(2) Description of the Prior Art

A conventional drum clothes washing machine is an electronic appliance in which clothes are washed by the suds generated by the rotation of its drum-type spin basket. With the conventional drum washing machine, washing, rinsing and hydro-extracting tasks are automatically carried out according to a specific program. After the washing and rinsing steps, excess water is removed from the garment by centrifugal force created by the spin basket rotating at high speeds during the hydro-extracting step. Abnormal vibrations and noise may be produced by the uneven distribution of clothes in the spin basket during this step, so a balancing device is essential for the smooth operation of the appliance.

FIG. 9 is a perspective view of the overall construction of a conventional drum washing machine.

Referring to FIG. 9, the drum washing machine includes a housing 1, a tub 2 suspended by suspension springs 4*a* and shock-absorbing members 4*b* in the housing 1, and a spin basket 3 rotatably installed in the tub 2. The spin basket 3, which is rotated by an electric motor 5 installed on the bottom of the housing 1, includes a plurality of small holes 3*a* uniformly formed on its cylindrical surface, and a plurality of lifters 3*b* protruding inward. Water that is removed from clothes in the spin basket 3 by centrifugal force drains into the tub 2 through the small holes 3*a,* and the lifters 3*b* enhance the creation of suds as the spin basket 3 rotates.

In order to prevent the generation of vibrations during the washing/hydro-extracting process, counterweights, each of predetermined weight, are attached to the tub 2. An 11.4 kg front counterweight 6*a* is provided to the front of the tub 2, and a 12.2 kg upper counterweight 6*b* is mounted on the top surface of the tub 2. The counterweights 6*a* and 6*b* are made from cast iron and are joined to the tub 2 by bolts 7.

Rather than preventing the creation of vibrations by laundry unevenly distributed in the washing machine, such a conventional balancing device simply restrains the vibrations, and thus has inferior balancing characteristics.

Furthermore, the conventional balancing device does not restrain the unbalance in the initial stage because it reduces the vibrations after they have been already transmitted to the tub.

SUMMARY OF THE INVENTION

The present invention concerns a method of making a balancing device for a drum washing machine that can obviate the above-described problems and disadvantages of the conventional art.

It is an objective of the present invention to provide a method of making a drum washing machine balancing device that dynamically counteracts an imbalance, created by the uneven distribution of laundry in the washing machine's spin basket during rotation, in the initial stage of the creation.

It is another objective of the present invention to provide a method of making a liquid supply hole for a drum washing machine balancing device, which holds liquid and movable bodies.

In order to obtain the aforementioned objectives, there is disclosed a method of making a balancing device for a drum washing machine that includes the steps of forming a race to contain a plurality of balls and a hole used for supplying oil to the race, supplying the oil to the inside of the race through the hole, and sealing the hole.

Multiple embodiments of the invention encompass several variations of the hole-sealing step. The first variation includes the substeps of adhering a stud's head to the hole's outside while the stud has a boss on its head and a shank extending from its head, and applying electricity to the race and the shank of the stud so that the stud and the hole are welded together to seal the hole. The shank is then cut away from the head.

The second variation of the hole-sealing step includes the substeps of adhering a welding agent and a closing member to the outside of the hole, and heating the closing member to fuse the welding agent onto the race, thus sealing the race's hole.

The third variation includes the substeps of welding a nut to the outside of the hole, and fastening a bolt onto the nut, thus sealing the race's hole. Alternatively, in the step of forming the race, a burr is formed on the hole protruding outward, and, in the step of sealing the hole, the welding process is carried out on the burr to thereby close the hole.

The last variation includes the substeps of connecting one end of a tube of a predetermined length to the burr's outside, compressing the protruding end of the tube, and then welding the compressed part of the tube to the hole.

DETAILED DESCRIPTION OF THE PREFERRED EMBODIMENTS

The preferred embodiments of the present invention will now be described in detail with reference to the accompanying drawings.

Figure 1:
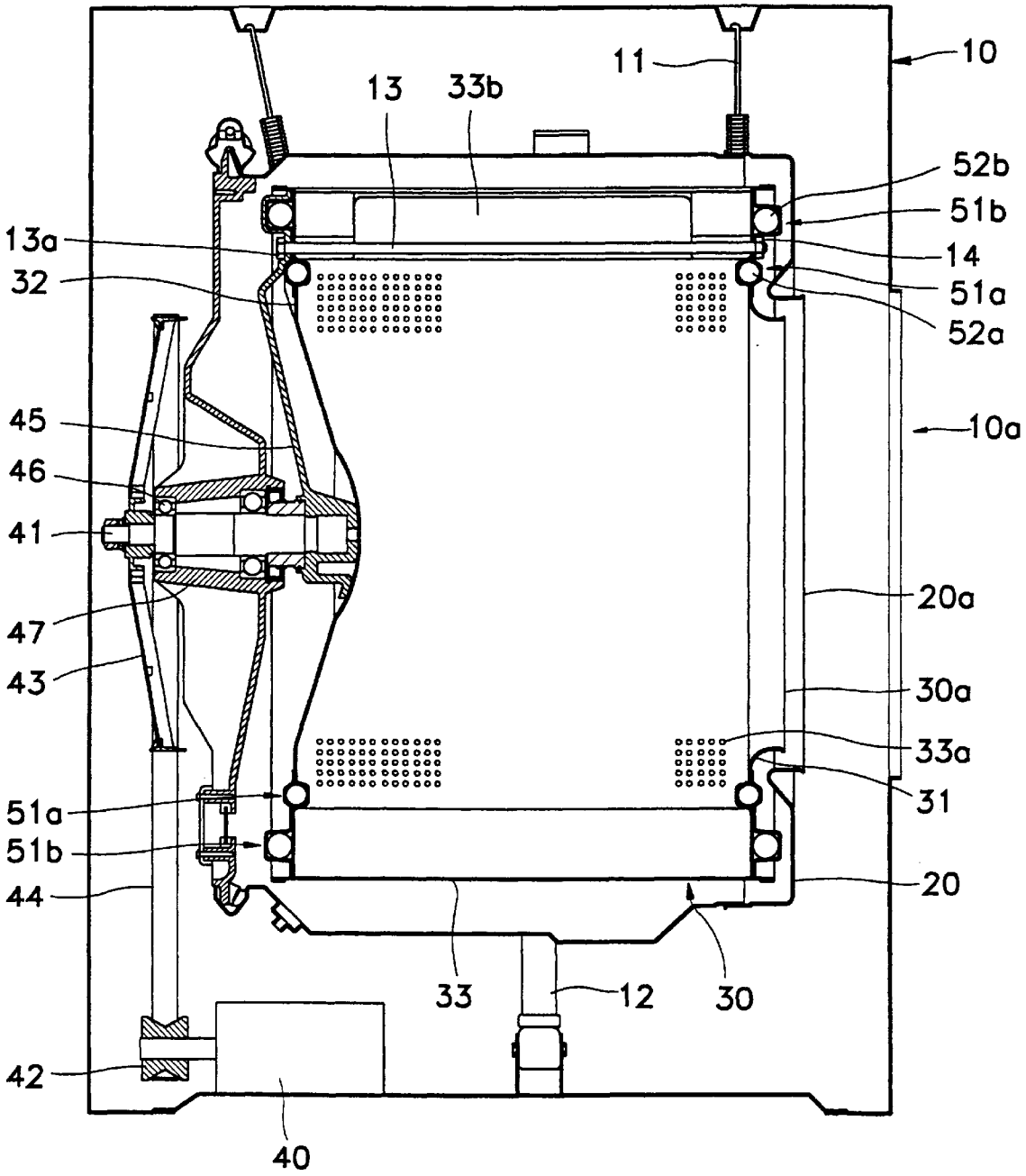
FIG. 1 is a sectional view of a drum washing machine with a balancing device in accordance with the present invention.

FIG. 1 is a sectional view for showing the overall construction of a drum washing machine equipped with a balancing device in accordance with the present invention.

As shown in FIG. 1, the drum washing machine includes a housing 10, a tub 20 suspended in the housing 10, a spin basket 30 rotatably installed within the tub 20, and an electric motor 40 mounted below the tub 20 to rotate the spin basket 30. The tub 20 is suspended by four springs 11 connected to opposite sides of the housing 10, and a pair of shock absorbing members 12 are provided under the tub 20.

The tub 20 and spin basket 30 have their axes installed parallel to the ground rather than upright, and openings 10*a*, 20*a* and 30*a* are respectively formed on the front of the housing 10, a predetermined spot of the tub 20 corresponding to the front of the housing 10, and a corresponding spot of the spin basket 30 so that laundry can be put into or taken out of the spin basket 30 therethrough.

The spin basket 30 consists of a cylindrically-shaped side panel 33, and front and rear panels 31 and 32 respectively joined to the front and back of the side panel 33. Three inward protruding lifters 33*b*, spaced 120° from each other, are formed on the side panel 33 in the form of a "V" for the purpose of raising and dropping the laundry during washing. A plurality of holes 33*a* are uniformly formed in the side panel 33, which allow water to flow freely between the tub 20 and the spin basket 30, and provide a path through which water removed from laundry during the hydro-extracting process can drain into the tub 20.

The rotating force of the electric motor 40 is transmitted to the spin basket 30 through the rear panel 32 by way of a shaft 41 connected thereto. The shaft 41, horizontally supported, extends from the rear panel 32 to the rear of the tub 20. A first pulley 42 is connected to the electric motor 40, and a second pulley 43 is connected to the shaft 41. A belt 44 is placed between the first and second pulleys 42 and 43, and a flange 45 is provided to the rear panel 32 connected with the shaft 41. A pair of bearings 46, positioned in a bearing housing 47, are installed between the shaft 41 and the tub 20 so as to support the shaft 41.

The spin basket 30 has a pair of balancing devices each provided to the front and rear panels 31 and 32 to remove the vibrations and imbalances created during its rotation. The balancing devices are realized as annular races 51*a* and 51*b* that are concentrically formed on inner and outer parts of the front and rear panels 31 and 32, and a plurality of spherical movable bodies (hereinafter, balls) 52*a* and 52*b* that are seated in the races 51*a* and 51*b*. As described above, the races 51*a* and 51*b* are placed on inner and outer parts of the front and rear panels 31 and 32, and the inner race 51*a* is disposed axially inward of the outer race 51*b* inward and outward, respectively. The inner race 51*a* and the outer race 51*b* are formed by welding, which also makes them hermetically sealed. The races 51*a* and 51*b* contain a predetermined amount of oil to allow the balls 52*a* and 52*b* to move freely.

The balancing device of the present invention will be more fully described as follows. Because the races 51*a* and 51*b* provided to the front panel 31 and rear panel 32 are formed symmetrically, only the structure of the races 51*a* and 51*b* on the front panel 31 will be described.

Figure 2:
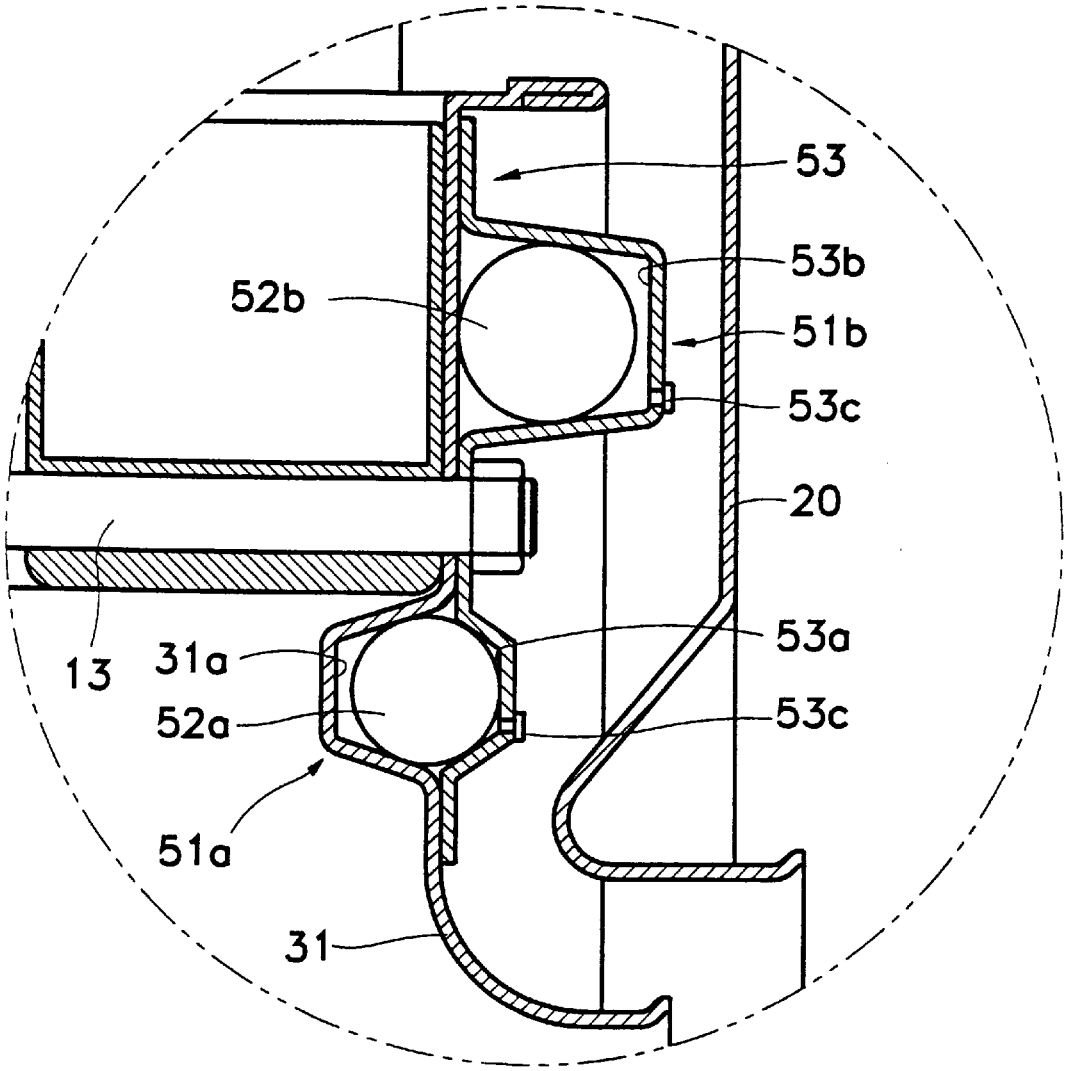
FIG. 2 is an enlarged view of a part of the balancing device of FIG. 1.

As shown in FIG. 2, the races 51*a* and 51*b* are shaped by the front panel 31 and a cover 53 coupled to the front panel 31. The outer race 51*b* is formed by the combination of the flat portion of the front panel 31 and a groove 53*b* created in the cover 53. The inner race 51*a* is formed by the combination of a first groove 31*a* of the front panel 31 and a second groove 53*a* of the cover 53. Each of the races 51*a* and 51*b* is supplied with oil through a hole 53*c* formed thereon. Each hole 53*c* is formed out of the path of the balls 52*a* and 52*c*, so as to not be a hinderance to their movement.

The following description relates to the method of making the balancing device.

Figure 3:
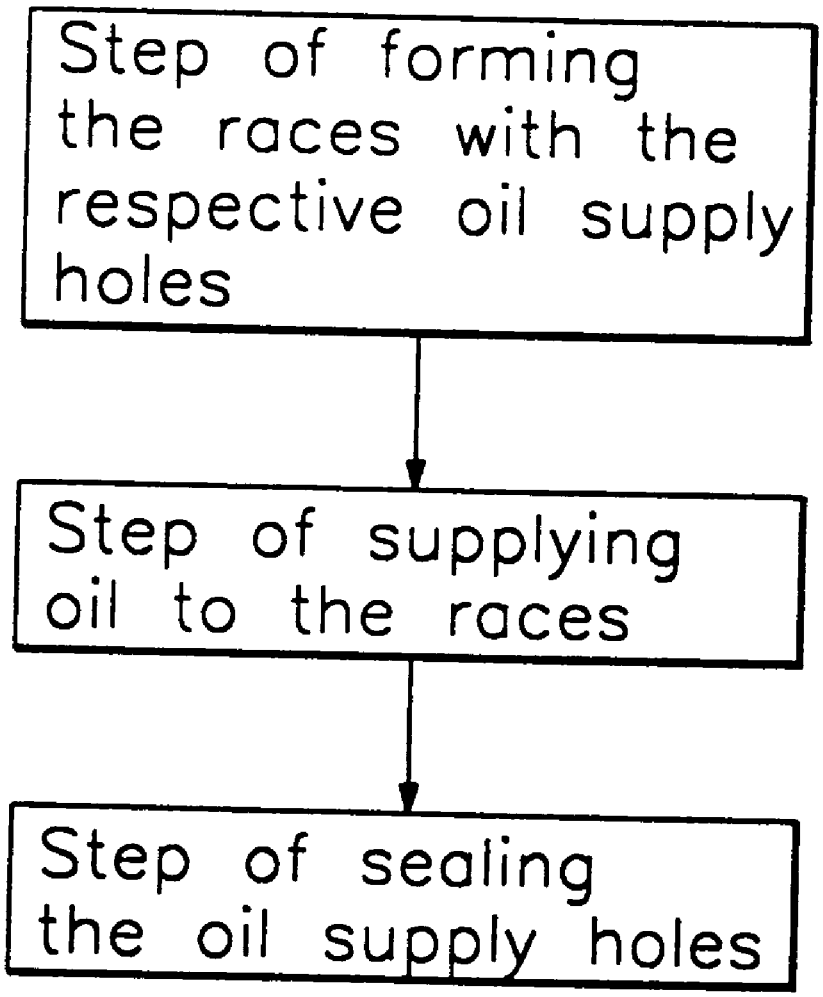
FIG. 3 is a flow chart of the manufacture of the balancing device in accordance with the present invention.

Referring to FIG. 3, the method of making the balancing device includes the steps of forming the races with the respective oil supply holes, supplying oil to the races through the oil supply holes, and sealing the oil supply holes. Referring to FIGS. 1 and 2, in the step of forming the races, the first groove 31*a* constituting the inner race 51*a* is formed on the front panel 31. Next, the second groove 53*a* and groove 53*b* for the respective inner race 51*a* and outer race 51*b*, and the oil supply hole 53*c* are then formed on the cover 53. The oil supply holes 53*c* are made by punching the cover 53 from its inside to the outside so as to prevent the movement of the balls 52*a* and 52*b* from being obstructed by a burr created during its formation. After putting the balls 52*a* and 52*b* in the grooves 53*a* and 53*b*, the cover 53 is welded to the front panel 31. Finally, the cover 53, the front panel 31, and the rear panel 32 are all fastened together by a bolt 13.

In the step of supplying oil to the races, a predetermined amount of oil is furnished to the races 51*a* and 51*b* through the holes 53*c*. After the completion of oil supply, the step of sealing the holes 53*c* is carried out to prevent oil leakage.

The present invention discloses several preferred embodiments for the step of sealing the holes 53*c*.

Figure 4A:
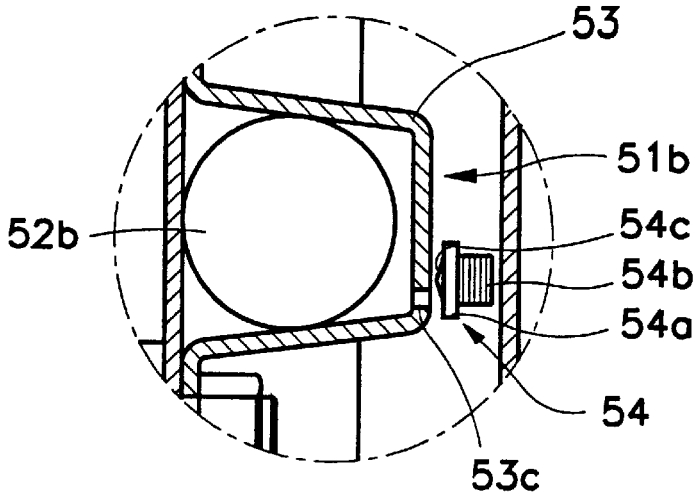
FIGS. 4A, 4B and 4C show the steps of sealing a liquid supply hole in accordance with a first preferred embodiment of the present invention.
Figure 4B:
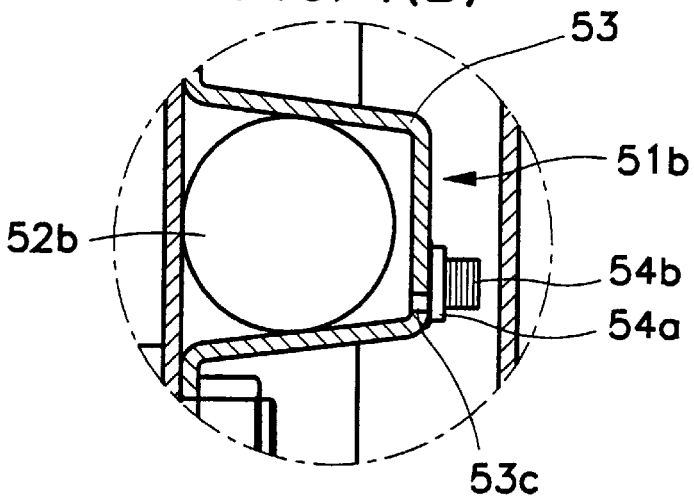
Figure 4C:
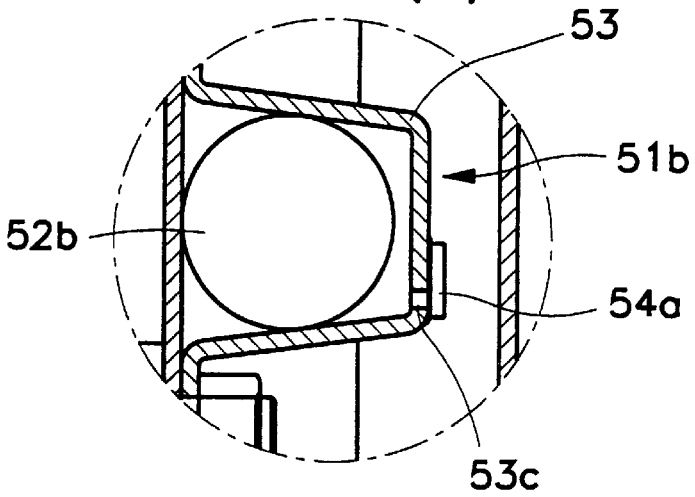

FIGS. 4A, 4B and 4C show the steps of sealing the liquid supply hole 53*c* in accordance with the first preferred embodiment of the present invention.

In the first preferred embodiment, the holes 53*c* are sealed by the use of a stud 54. As shown in FIGS. 4A, 4B and 4C, the sealing of the liquid supply hole includes the steps of adhering the stud 54 to the outside of the hole 53*c*, joining the stud 54 thereto by arc-welding, and cutting away the unnecessary part of the stud 54. The stud 54, whose diameter is larger than that of the hole 53*c*, has a head 54*a* that is affixed to the cover 53 and a shank 54*b* extending from the head 54*a*. Because the shank 54*b* is used for the application of electricity, there is a boss 54*c* on the head 54*a* that induces an arc. After covering the hole 53*c* with the stud 54 from the outside, electricity is applied to the shank 54*b* and the cover 53 so that the stud 54 is joined to the outside of the hole 53*c*, thus sealing the hole 53*c*. The shank 54*b*, the unnecessary part of the stud 54, is cut away afterwards.

Figure 5A:
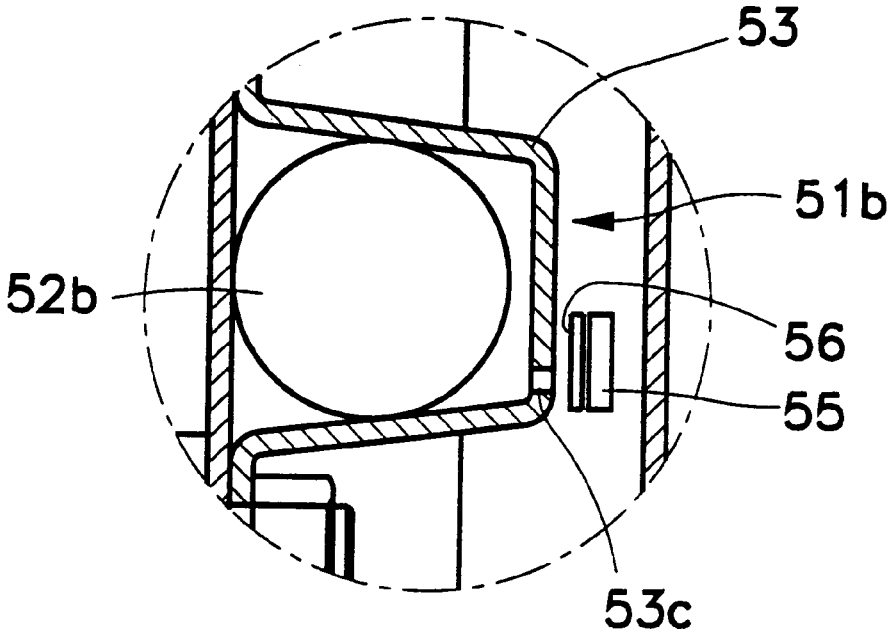
FIGS. 5A and 5B show the steps of sealing a liquid supply hole in accordance with a second preferred embodiment of the present invention.
Figure 5B:
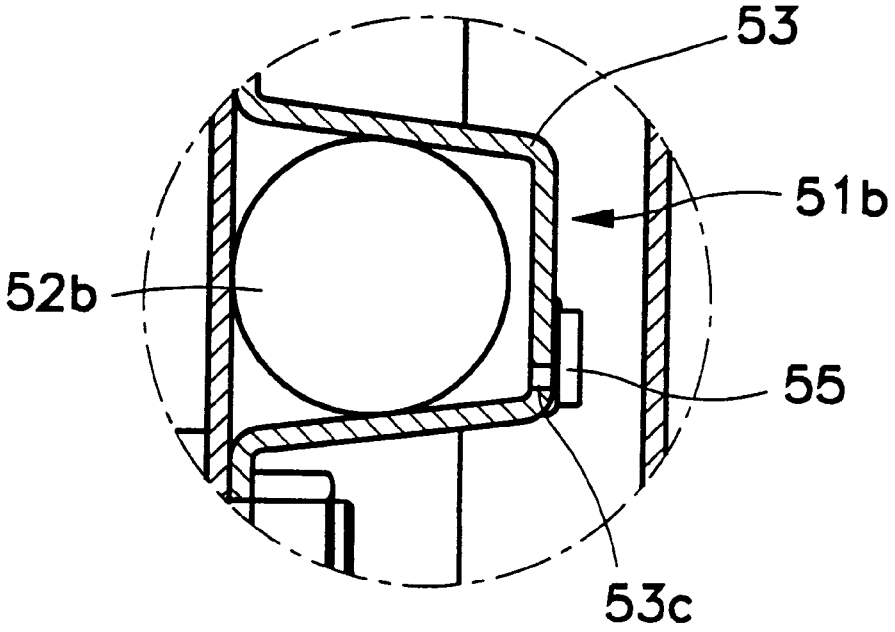

FIGS. 5A and 5B show the steps of sealing the liquid supply hole 53*c* in accordance with the second preferred embodiment of the present invention.

In the second preferred embodiment, the sealing of the liquid supply hole includes the steps of providing a welding agent 56 and a closing member 55 to the outside of the hole 53*c* (FIG. 5A), fusing the welding agent 56 by gas-welding or high-frequency welding and bonding the closing member 55 to the cover 53 with the fused the welding agent 56 to seal the hole 53*c* (refer to FIG. 5B).

Figure 6A:
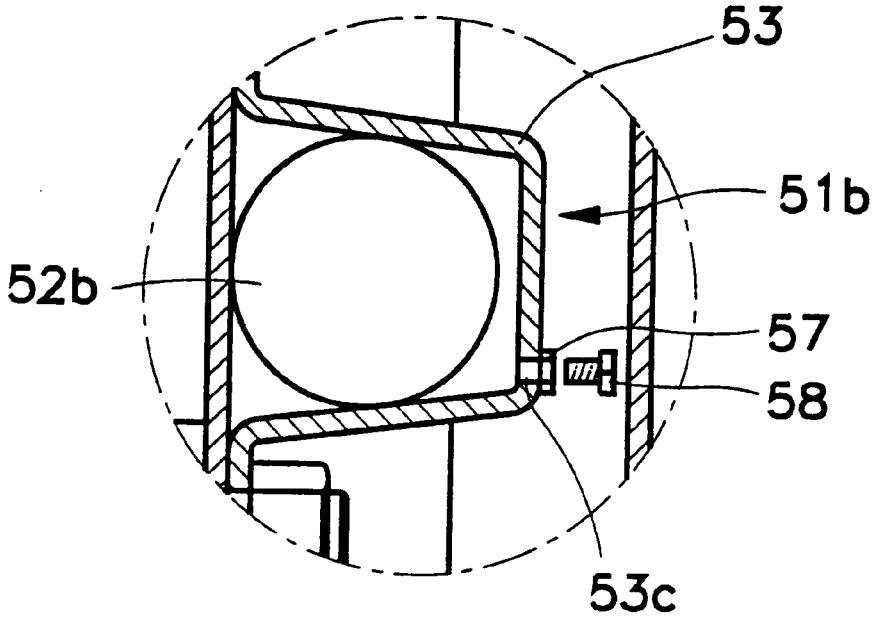
FIGS. 6A and 6B show the steps of sealing a liquid supply hole in accordance with a third preferred embodiment of the present invention.
Figure 6B:
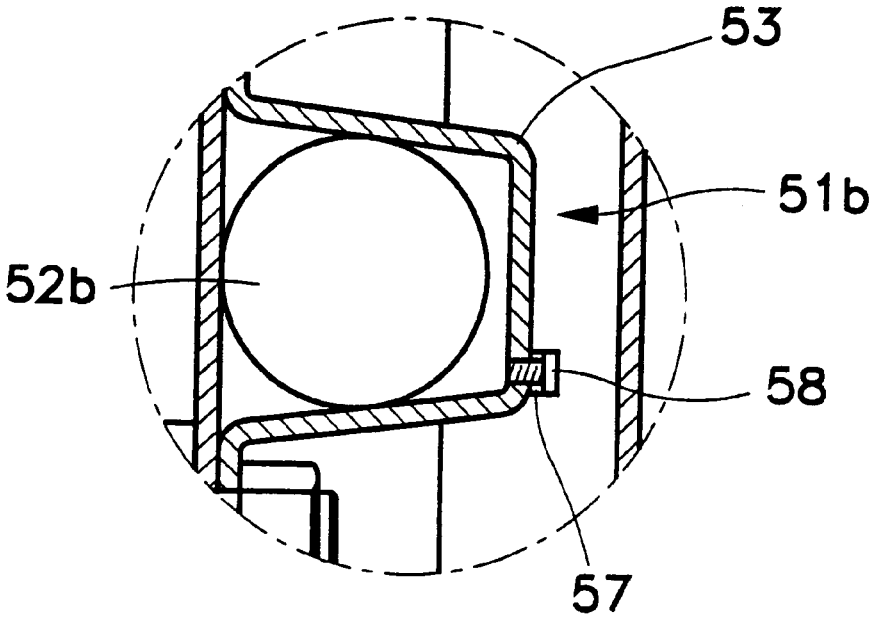

FIGS. 6A and 6B show the steps in the sealing of the liquid supply hole 53*c* in accordance with the third preferred embodiment of the present invention.

The sealing of the liquid supply hole 53*c* of the third preferred embodiment includes the steps of welding a nut 57 to the outside of the hole 53*c* (refer to FIG. 6A), and fastening a bolt 58 onto the nut 57, thus sealing the hole 53*c* (refer to FIG. 6B). It is preferable that the bolt 58's inner end does not protrude to the inside of its respective race 51*a* and 51*b*, so as to allow the balls 52*a* and 52*b* to move unobstructed.

Figure 7A:
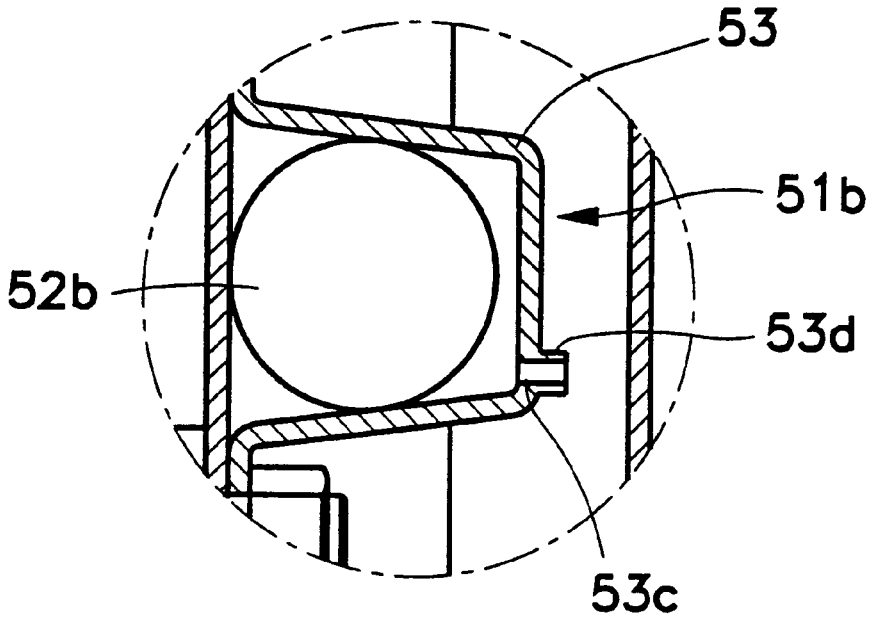
FIGS. 7A and 7B show the steps of sealing a liquid supply hole in accordance with a firth preferred embodiment of the present invention.
Figure 7B:
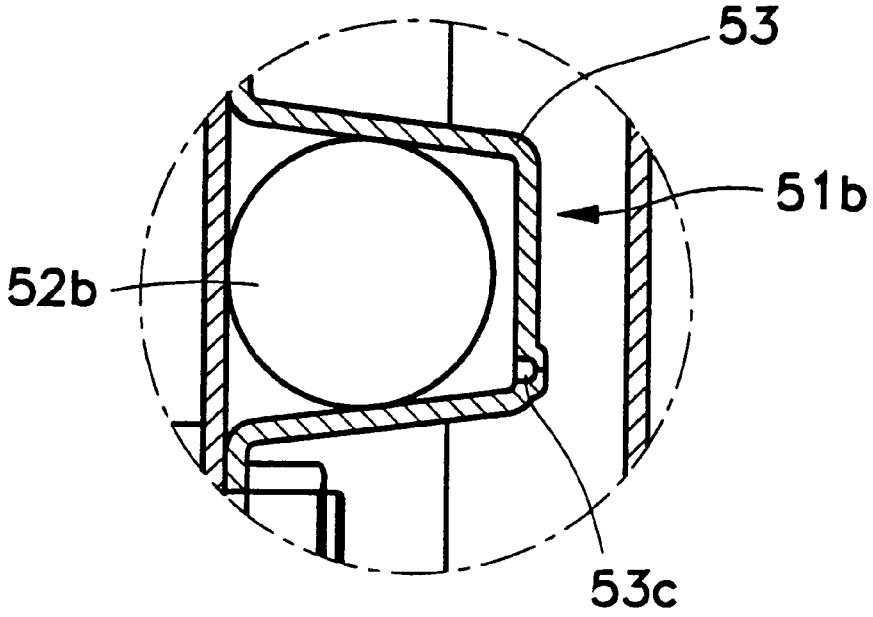

FIGS. 7A and 7B show the steps of sealing the liquid supply hole 53*c* in accordance with the fourth preferred embodiment of the present invention.

As shown in FIG. 7A, when a hole 53*c* is formed on the cover 53 in the step of forming the race 51*b,* a burr 53*d* is formed protruding outward. After the race 51*b* is filled with oil, the welding process is carried out on the outer end of the burr 53*d,* thus sealing welding the hole 53*c.*

Figure 8A:
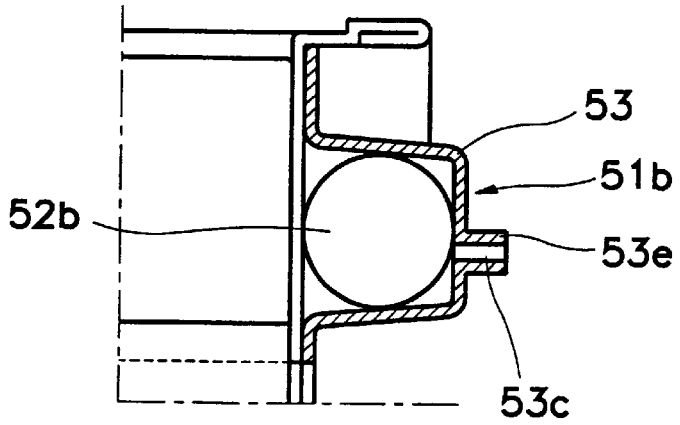
FIGS. 8A, 8B and 8C show the steps of sealing a liquid supply hole in accordance with a fifth preferred embodiment of the present invention.
Figure 8B:
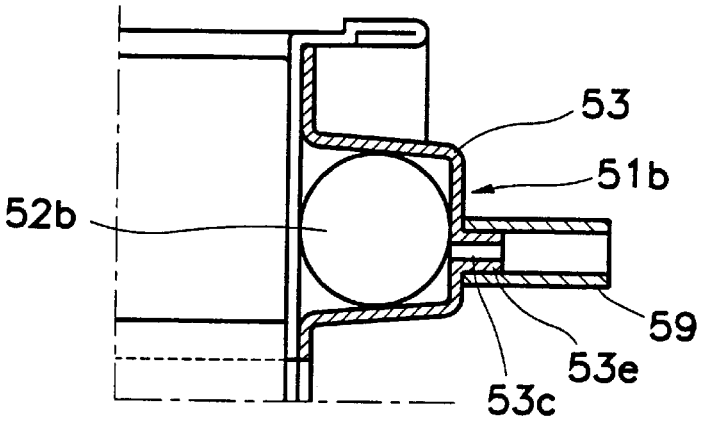
Figure 8C:
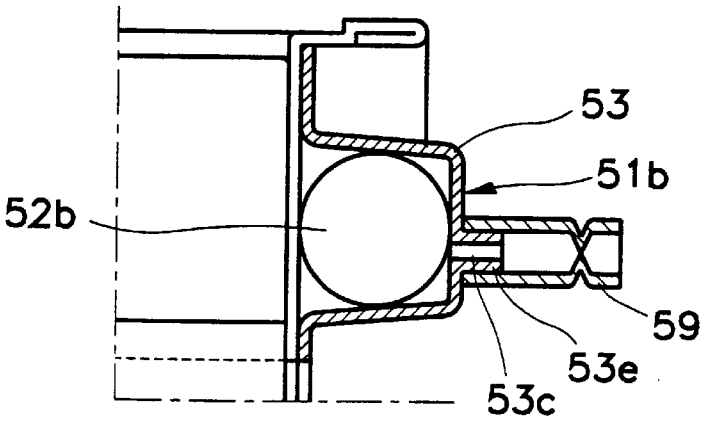
Figure 9:
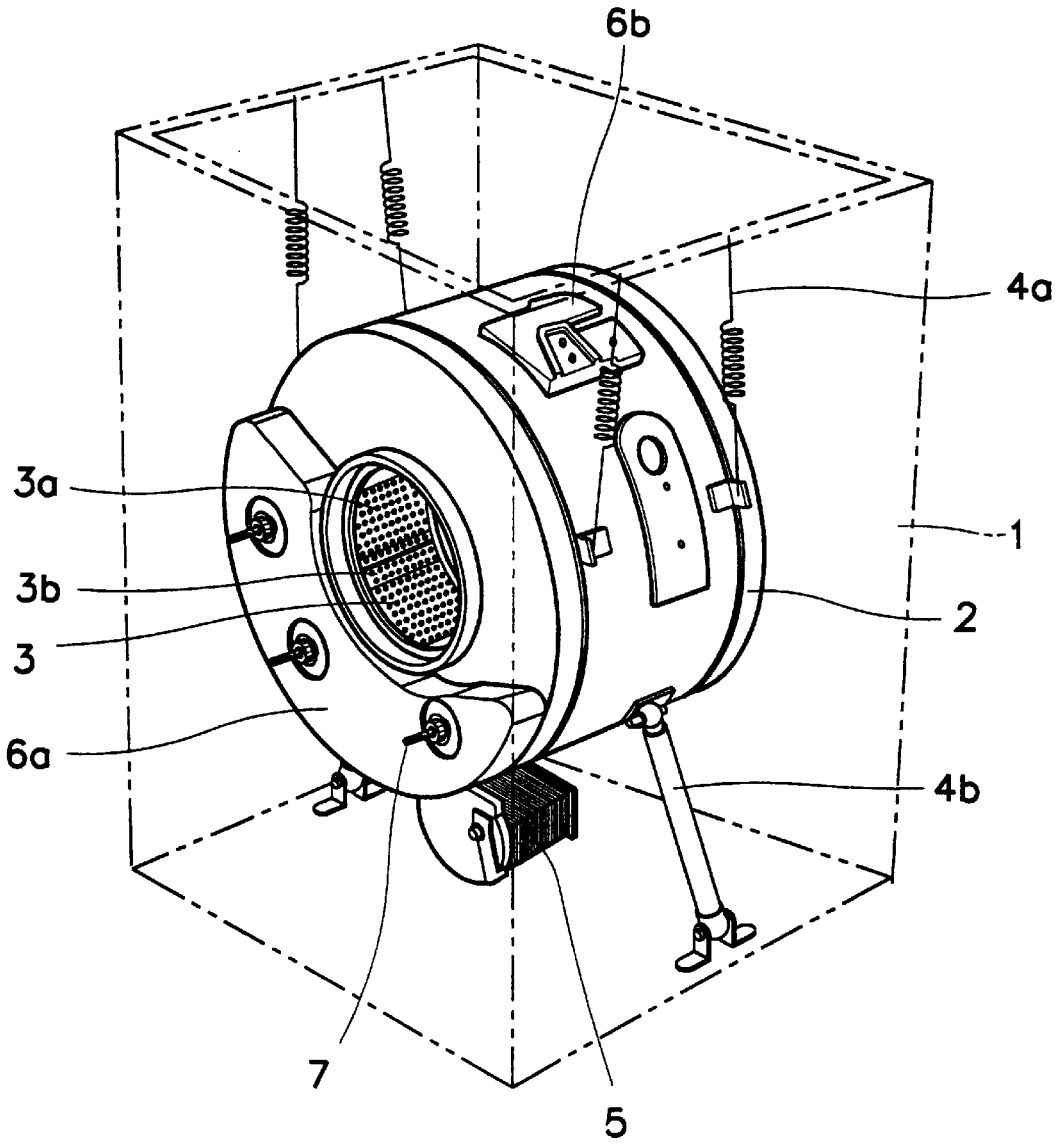
FIG. 9 (Prior Art)
FIG. 9 is a perspective view of the overall construction of a conventional drum washing machine.

FIGS. 8A, 8B and 8C show the steps of sealing the liquid supply hole 53*c* in accordance with the fifth preferred embodiment of the present invention. According to the fifth preferred embodiment, when a hole 53*c* is formed on the cover 53 in the step of forming the race 51*b,* a burr 53*e* is formed protruding outer, as shown in FIG. 8A. The sealing of the hole 53*c* includes the steps of connecting a tube 59 of a predetermined length to the burr 53*e* (FIG. 8B), compressing the outer end of the tube 59 to close it up, and sealing the hole 53*c* by welding the compressed part (FIG. 8C). The step of connecting the tube 59 to the burr 53*e* may be carried out before or after the oil fills the race 51*b.* Welding the tube 59 to the burr 53*e* before the race 51*b* is filled can prevent the oxidization of the oil or a change in its viscosity that may occur due to the heat produced in the welding process.

The hole 53*c* may be sealed by a rivet though it is not presented by a drawing. More specifically, this sealing of the hole 53*c* is realized by passing a rivet, whose head is positioned outside of the hole 53*c,* through the hole 53*c* and the front or rear panel 31 or 32 being opposed to the hole 53*c,* providing a gasket to both ends of the rivet, and then rivetting on the inside of the front or rear panel 31 or 32 with a rivet gun.

The following description concerns the operation of the balancing device manufactured according to the above-described method.

Garments to be washed are positioned on the bottom of the spin basket 30. As the spin basket 30 is rotated at high speeds by the electric motor 40 when the garments are not evenly arranged therein, the balls 52*a* and 52*b* move along the races 51*a* and 51*b* toward the opposite side of the imbalance by centrifugal force generated by the high-speed rotation of the spin basket 30, thereby compensating for the imbalance and preventing the vibration and eccentric rotation of the spin basket 30.

In other words, the spin basket 30 turns eccentric from its geometric center due to the uneven distribution of laundry within the spin basket 30. The centrifugal force from the geometric center and that of its center of rotation simultaneously act on the balls 52*a* and 52*b* in the races 51*a* and 51*b,* so that the balls 52*a* and 52*b* are repositioned to oppose the imbalance. The balls 52*a* and 52*b* turn about the geometric center of the spin basket 30, thus making the center of rotation of the spin basket 30 meet the geometric center. In this manner, the unbalanced state of the spin basket 30 is dynamically countered to eliminate the resultant vibrations and noise.

The inventive balancing device also prevents the unnecessary wear of the components used to support the rotation of the spin basket.

In addition, the inventive method of making the balancing device for the drum washing machine, provides a perfect seal to the oil supply holes to avoid oil leakage. As shown in the fifth preferred embodiment (FIGS. 8A–8C), the welded parts of the races is spaced a set distance away from the oil, thereby preventing the expansion of the oil and air, or the oxidization of the oil or a change in its viscosity due to heat generated by the welding process.

What is claimed is:

1. A method of making a balancing device for a drum washing machine, comprising the steps of:

A) forming a race containing a plurality of balls and a hole, wherein a burr is formed on the hole protruding outwards;

B) supplying oil into the race through the hole; and

C) sealing the hole by connecting one end of a tube of a predetermined length to the outside of the burr, compressing the protruding end of the tube, and then welding the compressed part of the tube.

* * * * *